US006361657B2

(12) United States Patent
McPherson

(10) Patent No.: US 6,361,657 B2
(45) Date of Patent: Mar. 26, 2002

(54) TWIN FABRIC FORMING SECTION BLADE MOUNTING

(76) Inventor: Douglas R. McPherson, 4 Metacomet Dr., East Granby, CT (US) 06026

( * ) Notice: Subject to any disclaimer, the term of this patent is extended or adjusted under 35 U.S.C. 154(b) by 0 days.

(21) Appl. No.: 09/765,396

(22) Filed: Jan. 22, 2001

Related U.S. Application Data

(63) Continuation-in-part of application No. 09/442,033, filed on Nov. 17, 1999, now abandoned.

(30) Foreign Application Priority Data

Nov. 15, 2000 (WO) ..... PCT/CA00/01351

(51) Int. Cl.[7] ..... D21F 1/54
(52) U.S. Cl. ..... 162/301; 162/352
(58) Field of Search ..... 162/352, 374, 162/301

(56) References Cited

U.S. PATENT DOCUMENTS

| | | | | |
|---|---|---|---|---|
| 3,017,930 A | | 1/1962 | Dunlap | |
| 3,027,940 A | | 4/1962 | Dunlap | |
| 3,140,225 A | | 7/1964 | Truxa | |
| 3,201,308 A | | 8/1965 | Goddard et al. | |
| 3,220,920 A | | 11/1965 | Truxa | |
| 3,377,236 A | | 4/1968 | Roecker | |
| 3,520,775 A | | 7/1970 | Truxa | |
| 3,529,315 A | | 9/1970 | Dunlap et al. | |
| 3,535,201 A | | 10/1970 | Reynolds et al. | |
| 3,647,620 A | | 3/1972 | Truxa | |
| 3,866,266 A | | 2/1975 | Dunlap | |
| 4,559,105 A | | 12/1985 | Sennett et al. | |
| 4,648,943 A | * | 3/1987 | Malenshenko | 162/352 |
| 4,865,692 A | | 9/1989 | Kade et al. | |
| 5,045,153 A | | 9/1991 | Sollinger et al. | |
| 5,061,347 A | | 10/1991 | Bubik et al. | |
| 5,078,835 A | | 1/1992 | Schiel et al. | |
| 5,129,992 A | | 7/1992 | Schiel et al. | |
| 5,169,500 A | | 12/1992 | Mejdell | |
| 5,211,814 A | | 5/1993 | Jaakkola et al. | |
| 5,262,009 A | | 11/1993 | Schiel et al. | |
| 5,262,010 A | | 11/1993 | Bubik et al. | |
| 5,437,769 A | | 8/1995 | Bando et al. | |
| 5,486,270 A | | 1/1996 | Schiel | |

(List continued on next page.)

FOREIGN PATENT DOCUMENTS

| | | |
|---|---|---|
| CA | 2106355 | 3/1994 |
| DE | 42 42 658 | 6/1994 |
| EP | 0 900 877 | 3/1999 |

*Primary Examiner*—Karen M. Hastings
(74) *Attorney, Agent, or Firm*—Robert A. Wilkes; Robert G. Hendry; Harold C. Baker

(57) ABSTRACT

A flexible mounting for use in the forming section of a twin forming fabric paper making machine consisting essentially of a base member supported by the paper making machine structure to which is attached a flexible C-shaped beam. The C-shaped beam has one edge attached to the base member, and a fabric contacting blade attachment means at the other edge. A pressurized loading tube is located within the C-shaped beam between the base member and the second edge of the C-shaped beam. When the pressurized loading tube is loaded, the C-shaped beam flexes thus allowing the blade to move initially into contact with a forming fabric. As the pressurized tube is further loaded, the contact face of the blade is moved into further engagement with the forming fabric. In a preferred construction, the wrap angle of the fabrics at or about the blade leading edge can be minimized. The mounting thus can diminish wear of the fabric as it passes over the blade. The mounting also allows localized flexing in the blade to accommodate localized variations in conditions, such as variations in stock thickness. The mounting can also include vents whereby liquid accumulated upstream of the blade is vented downstream of the mounting.

23 Claims, 5 Drawing Sheets

U.S. PATENT DOCUMENTS 5,507,918 A 4/1996 Polifke et al.
5,552,021 A 9/1996 Ilvespää et al.
5,573,643 A 11/1996 Jaakkola et al.
5,607,554 A 3/1997 Poikolainen
5,647,958 A 7/1997 Schmidt-Rohr et al.
5,660,689 A 8/1997 Bartelmuss et al.
5,690,792 A 11/1997 Jaakkola et al.
5,695,613 A 12/1997 Hentilä et al.
5,851,359 A 12/1998 Salminen et al.
5,871,617 A 2/1999 Iwata et al.
6,183,602 B1 * 2/2001 Iwata et al. ..... 162/352

* cited by examiner

TWIN FABRIC FORMING SECTION BLADE MOUNTING

This application is a continuation-in-part of U.S. Pat. No. 09/442,033 filed Nov. 17, 1999, and now abandoned.

FIELD OF THE INVENTION

The present invention relates to a mounting assembly for use with resiliently mounted blades located opposite to a forming shoe in the forming section of a twin fabric paper-making machine. In such a machine, since the blades are located on each side of the two fabrics, each blade contacts only the machine side of the nearer fabric. This invention is particularly concerned with a flexible mounting which allows the blades mounted thereon to conform locally to Z-direction variations in the path of the forming fabrics across the width of the moving forming fabrics. The flexible mounting allows the blade to move so that the angle of wrap of the forming fabrics as they pass in sliding contact over the fabric contacting surface of the blade is maximized at one of the blade edges and minimized at the other as the blade is displaced further towards the fabrics.

BACKGROUND OF THE INVENTION

Many structures have been proposed for mounting static forming fabric supporting elements, such as blades, which are used in the forming section of a two, or twin, fabric paper making machine, in which the aqueous stock is injected or conveyed into the space between two opposed forming fabrics. In the forming section, blades in contact with the machine side of each forming fabric are used to improve formation and to assist in the removal of fluid so that an incipient paper web is formed. In certain forming sections of this type, the two forming fabrics moving as a pair are caused to wrap about blades located on both sides of the two forming fabrics and thus follow a somewhat zigzag path through the forming section.

In twin fabric forming sections equipped with opposed blades, a first set of flexibly mounted blades is located on one side of the fabrics, and a second set of more or less rigidly mounted blades is located on the other side of the fabrics. Suitable machine structures are provided to support both sets of blades, which are collectively referred to as forming shoes. The flexible mountings often utilize arrangements of pressurized hoses or springs to urge the blades into contact with the adjacent one of the two forming fabrics. This invention is concerned with an improved means for flexibly mounting these blades, in which the mounting is flexible in essentially two ways. First, the mounting means of this invention permits the blade to be forced into uniform intimate contact with the machine side of the nearer forming fabric across the width of the forming section. Second, the mounting allows parts of the blade to deflect in the Z-direction locally across the width of the forming fabric in response to localized variations that may occur, and still maintain the blade in intimate contact with the face of the forming fabric.

In the context of this invention, the following terms have the meanings given:

"machine direction" means a direction substantially parallel to, or coincident with, the overall direction of travel of the pair of forming fabrics through the forming section;

"cross machine direction" means a direction essentially within the plane of the forming fabrics and perpendicular to-the machine direction;

"Z-direction" means a direction essentially perpendicular to both the machine and cross machine directions, and "blade" means any stationary fabric contact element used in the forming section of a twin fabric paper making machine.

Many arrangements have been proposed in the prior art for resiliently mounting the fabric contacting elements used in a twin fabric forming section. These known mountings locate the blades in the cross machine direction, and provide for movement of the blades in more or less the ""Z-direction". However, in these mountings, Z-direction movement of the blades often involves frictional sliding between fixed and moveable parts of the mounting, which is frequently hampered by clogging of the mechanism by fibers and other matter. Further, in the known prior art arrangements the sliding movement components are generally stiff and inflexible, and thus do not allow for any localized flexing of the blade in the Z-direction in response to localized changes in conditions. Consequently, when localized misalignment of the blade with the forming fabric occurs, areas of poor formation and uneven drainage occur across the incipient paper web.

Many of the prior art mounting means cause the blade to move towards the fabrics in the Z-direction, and maintain the fabric contacting surface of the blade generally perpendicular to that direction. Further Z-direction movement causes the fabrics to wrap over the blades more or less symmetrically, which increases frictional contact between both the leading and trailing edges of the blade and the machine side of the forming fabric. This contact is known to accelerate the rate of fabric wear. To reduce the rate of fabric abrasive wear due to the wrap angle at the sharp leading edge, the radius of curvature of the blade leading edge is often increased. This has been found to create new problems, because any fluid that was adhering to the machine side surface of the forming fabric will be propelled back into the stock by the rounder edge as the fabrics pass over the fabric contacting surface of the blade. This phenomenon has been found to impair paper formation.

Kade et al, in U.S. Pat. No. 4,865,692, disclose a support structure for a blade, for use in a conventional single fabric open surface forming section. In this structure, two C-section beams extending across the width of the machine are interlocked to provide an essentially S-shaped structure. The upper C-beam carries the blade, and the lower C-beam is mounted onto the drainage box. The two C-beams are joined together by a flexible spring steel strip, and are urged apart by a clamping element so that the two C-beams engage to form the S-shape. The clamping element is typically an inflatable hose. An adjusting beam is also located between the two C-beams, which also carry stop surfaces. By moving the adjusting beam, different stop surfaces are engaged by pressurizing the clamping means, thus altering the angle of inclination of the fabric contacting surface relative to the machine direction of movement of the fabric. However, this structure only allows a small angular change, the axis about which the angle changes is not defined with any precision, and interlocking of the two C-beams into an S-shaped structure precludes any movement in the Z-direction. Further, although movement of the upper C-beam does not involve any sliding contact, that movement is controlled by the sliding adjusting beam.

BRIEF DESCRIPTION OF THE INVENTION

The present invention seeks to provide a mounting for a blade in the forming section of a two fabric paper making machine which allows for movement of the complete blade in the Z-direction, localized flexibility of the blade across the width of the forming section in the Z-direction, and some freedom to alter the angle of inclination of the contacting surface in relation to the undeflected path of the forming fabrics. The mounting allows the fabric contacting surface of the blade to be urged into contact with one of the pair of forming fabrics so that it is initially oriented substantially parallel to the contacted surface of the undeflected forming fabric. The blade mounting provides the option of allowing the blade to engage the fabrics so that their angle of wrap about the blade is minimized at the leading edge, and maximized at the trailing edge. This is because the mounting allows the blade to rotate over an arc as it is displaced towards the fabrics. This arrangement reduces the angle of wrap of the forming fabrics about the leading edge of the blade, and permits the use of a relatively sharp doctoring leading edge on the blade. Alternatively, the mounting allows the blade to be engaged with the fabrics so that the wrap angle is maximized at the leading edge, and minimized at the trailing edge. If this arrangement is used, then it is recommended that the radius of curvature of the doctoring leading edge of the blade be increased to reduce fabric wear. The mounting additionally allows the blade to flex locally in the Z-direction, in response to local changes across the width of the forming section, so that the blade conforms more reliably to the line of fabric travel. Since the mounting involves no parts moving in sliding contact, and can also be readily protected from fibers and other solids in the stock, a simple means of controlled movement is provided, whereby more even pressure can be maintained across the width of the forming fabrics, thus reducing defects in the incipient paper web.

Thus in its broadest embodiment, this invention seeks to provide a flexible mounting for use in the forming section of a twin forming fabric paper making machine consisting essentially of:

- a base member constructed and arranged to be supported by a paper making machine structure;
- a flexible C-shaped beam, having a first beam portion having a first edge and having a second beam portion having a second edge, the first edge of the first beam portion being attached to the base member;
- a fabric contacting blade attachment means, having a leading and a trailing face, attached to the second edge of the C-shaped beam; and
- a pressurized loading tube located within the C-shaped beam between the base member and the second edge of the C-shaped beam.

Preferably, the first and second beam portions are both arcuate to provide the C-shaped beam. In a first alternative structure, the first beam portion has a second edge, the second beam portion has a first edge, the first and second beam portions are both substantially flat, and the second edge of the first beam portion is attached at an angle at its second edge to the first edge of the second beam portion to provide the C-shaped beam. In a second alternative structure, the first beam portion has a second edge, the second beam portion has a first edge, the first and second beam portions are both substantially flat, the second edge of the first beam portion is attached at an angle at its second edge to the first edge of the second beam portion to provide the C-shaped beam, and the first and second beam portions are a unitary structure.

Preferably, the base member and the C-shaped beam are fabricated as two separate units and attached together. Alternatively, the base member and the C-shaped beam are fabricated as a single unitary construction.

Preferably, when a two part construction is used, the first edge of the C-shaped beam is attached to the base member by being lodged into a slot in the base member constructed and arranged to receive the first edge, and the first edge is retained therein by a suitable adhesive. Alternatively, the first edge of the C-shaped beam is mechanically engaged to the base member by means of a slot in the base member constructed and arranged to receive the first edge, or by means of a direct mechanical attachment means.

Preferably, the mounting further includes a flexible sealing means located between the second edge of the C-shaped member and the base member. More preferably, the sealing means comprises a flexible strip of suitable width. Preferably, the edges of the sealing strip are engaged in cooperating slots in the second edge of the C-shaped beam and the base member.

Preferably, the pressurized loading tube is located in a slot constructed and arranged in the base member to receive it. More preferably, the pressure tube further includes a pressure rib adjacent the second edge of the C-shaped beam.

Preferably, the fabric contacting blade attachment means attached to the second edge of the C-shaped beam further includes a leading face and a trailing face, together with liquid venting means connecting the leading face to the trailing face. More preferably, the liquid venting means comprises a series of holes or slots from the leading face to the trailing face through the fabric contacting blade attachment means, the holes or slots being spaced apart in the cross-machine direction.

DETAILED DESCRIPTION OF THE PREFERRED EMBODIMENTS

In the following description it is assumed for simplicity that the two forming fabrics run in a substantially horizontal direction. For machines with non-horizontal forming fabrics it is to be understood that terms such as "up" and "top" refer to a direction or location toward the fabrics, and are thus essentially in the Z-direction.

Figure 1:
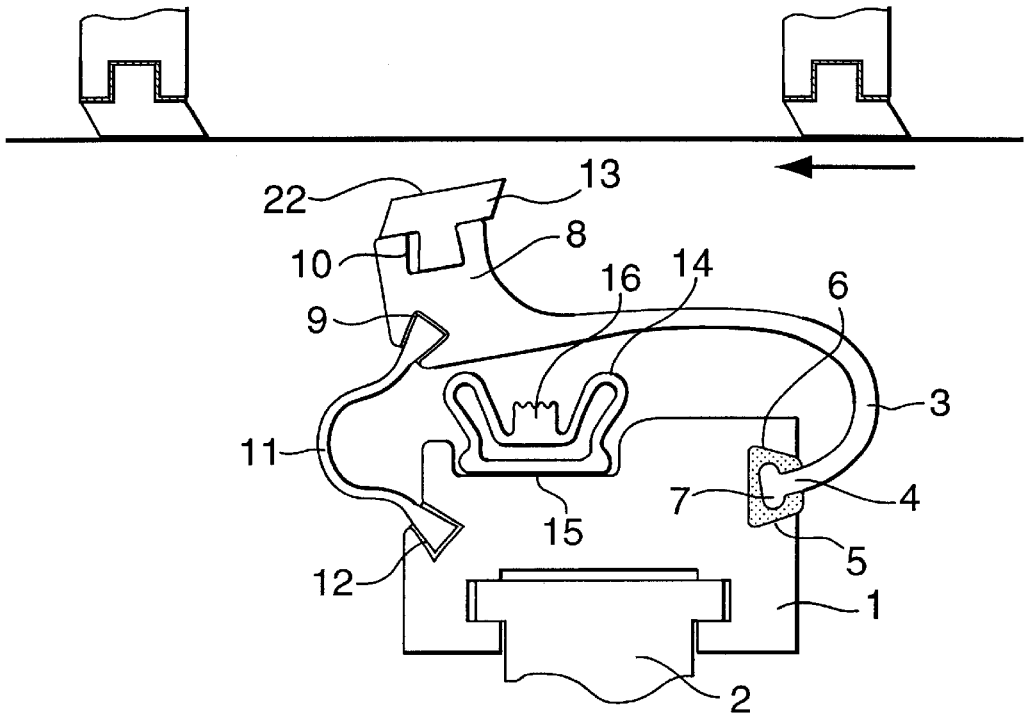
FIG. 1 shows a cross sectional diagram of one embodiment of the flexible mounting according to the invention on a forming shoe for a two fabric forming section, with the blade retracted.

Referring first to FIG. 1, the base member 1 supporting the flexible mounting is attached to a suitable support structure, for example by the conventional T-bar arrangement 2. Other mounting means are known and used. The flexible mounting comprises a beam 3 having a C-shaped cross section extending across the width of the forming section. The C-shaped beam 3 is ideally one single piece, unless its length precludes manufacture as one piece. If a multiple piece beam is used, the ends should be butted closely together. At its first edge 4 the C-shaped beam 3 is lodged into the slot 5 in the base member 1, and held in place by a suitable adhesive, casting or potting compound 6. The adhesive 6 is chosen to provide adequate engagement of the edge 4 into the slot 5, and to have an acceptable service life under the operating conditions of the forming section, which will place significant stresses on the adhesive. The cured adhesive either can be essentially rigid, or can provide a modicum of flexibility for the edge 4 in the slot 5. To ensure adequate engagement between the adhesive 6 and the first edge 4 of the C-shaped beam, ribs 7 can be provided, and the slot can have the dovetail shape shown.

It is thus apparent that although the C-shaped beam is securely held in the slot 5 by the adhesive 6, it can have some freedom to rotate relative to the mounting beam 1, by flexure of the compound 6.

At its second edge the C-shaped beam has a relatively thick rib 8, which includes two slots 9, 10. An approximately square cross section is suitable for the rib 8. The lower slot 9 engages the upper edge of a flexible sealing strip 11 which is conveniently an elastomer extrusion, and which extends across the width of the forming section. It is also desirable that the sealing strip is one piece; if more than one piece is used the ends should be closely butted together, and preferably cemented, to provide a water tight seal. The lower edge of the sealing strip 11 is engaged into a suitable slot 12 in the base beam 1. The upper slot 10 carries the fabric engaging blade 13. A pressurized loading tube 14 is located between the base beam 1 and the rib portion 8 of the C-shaped beam 3. The tube is conveniently retained in place by a suitable recess 15 in the base beam 1. The loading tube also conveniently includes a pressure rib 16 on its top surface.

Figure 2:
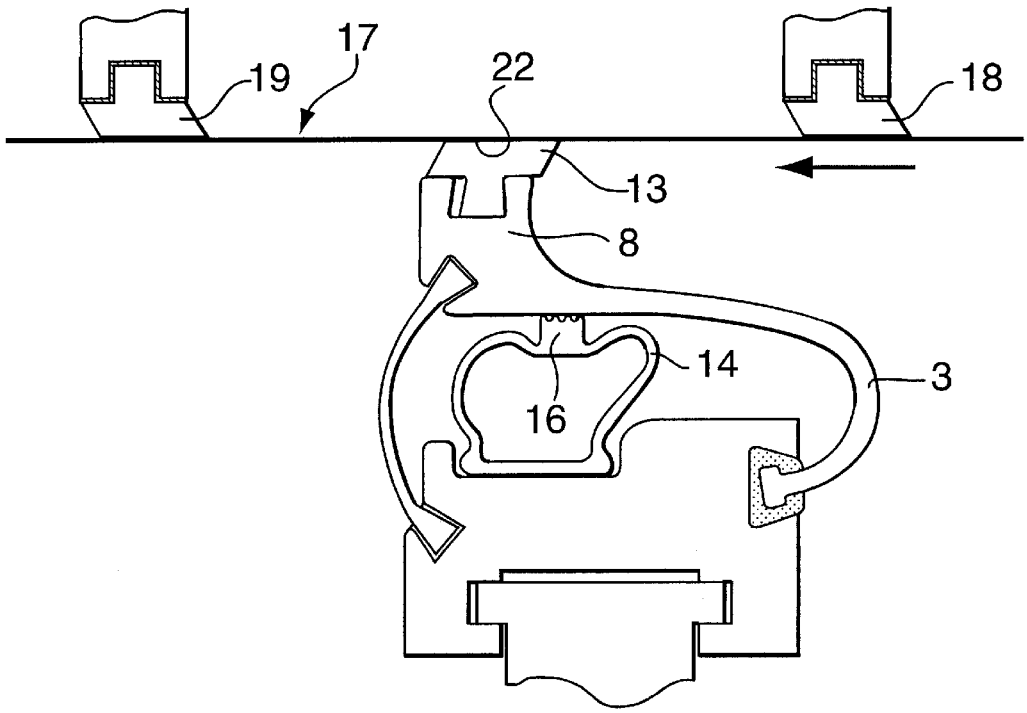
FIG. 2 shows the embodiment of FIG. 1 with the blade moved into sliding contact with the forming fabrics.
Figure 3:
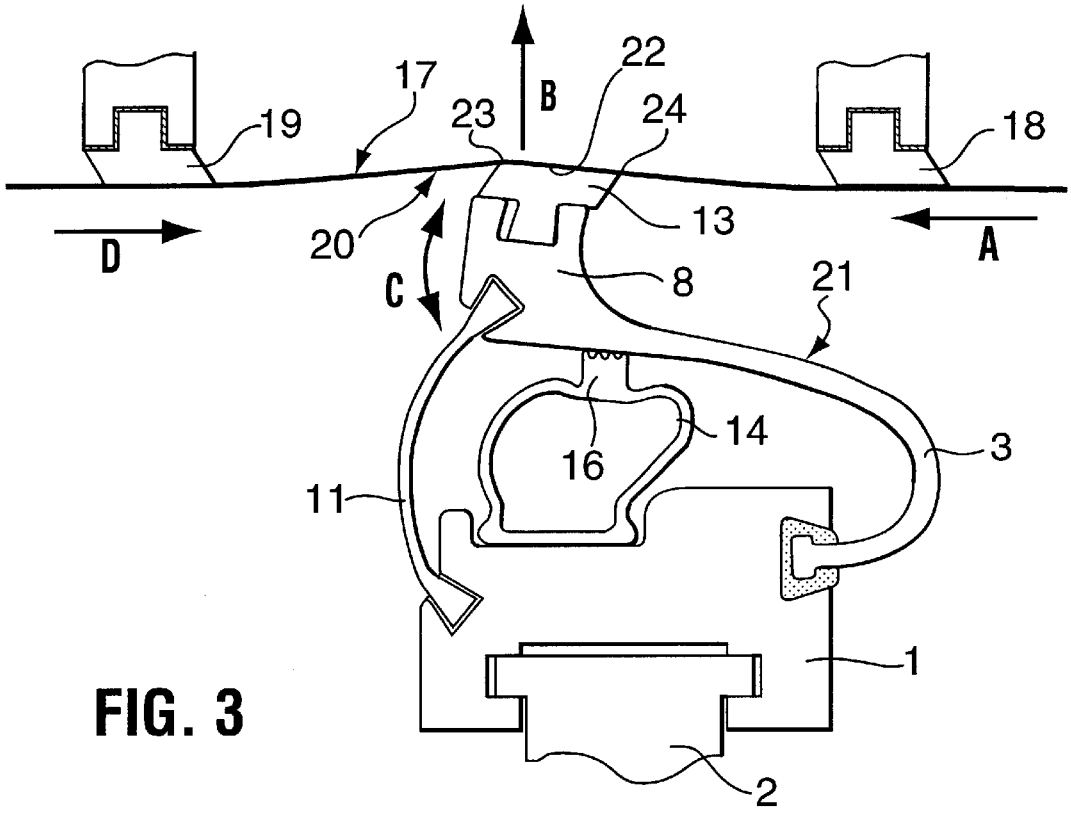
FIG. 3 shows the embodiment of FIG. 1 with the blade pressed into engagement sufficiently to deflect the forming fabrics.

Referring now to FIGS. 2 and 3, as the loading tube 14 is pressurized (for example with air or with a liquid under pressure) it expands, and engages the underside of the rib portion 8 of the second edge of the C-shaped beam 3. As the pressure is increased, the tube 14 expands and moves the blade 13 into sliding engagement with the nearer one of the forming fabrics 17 (see FIG. 2). Two fixed blades 18, 19 will generally be located on the other side of the forming fabrics in the forming shoe. In FIGS. 2 and 3 the forming fabrics move in the direction of the arrow A. As the loading tube continues to expand, blade 13 is moved further into engagement with the forming fabrics 17 as at 20 (see FIG. 3), and the two fabrics 17 are deflected somewhat in the Z-direction, as shown by the arrow B. At the same time, the flexible seal 11 is also extended. The C-shaped beam 3 has sufficient flexibility to bend in the area 21 to allow the blade 13 to contact the forming fabrics 17 and deflect them, and also to allow the rib portion 8 of the C-shaped beam 3 to rotate over an arc as indicated by the arrow C, so that, as shown in FIG. 2, the upper face 22 of the blade 13 is initially located to be substantially parallel to the run of the forming fabrics 17. Further expansion of the loading tube 14, as shown in FIG. 3, in addition to moving the blade 13 in the Z-direction, causes the rib portion 8, and the face of the blade 13 to move so that the leading edge 24 of the blade 13 is displaced a small distance towards the fabrics 17, and the trailing edge 23 is displaced a relatively greater distance toward the fabrics. This maximizes the wrap angle of the forming fabrics 17 at the trailing edge 23 of the blade 13, and minimizes the wrap angle at the leading edge 24 of the blade 13. This assists in reducing fabric wear caused by friction at the leading blade edge 24. When the loading tube 14 is depressurized, the C-shaped beam 3 retracts and moves the blade 13 to the position shown in FIG. 1, so that the blade 13 is not in contact with the forming fabrics 17. Alternatively, the blade can be mounted so that the angle of wrap is maximized at the blade leading edge, and minimized at the blade trailing edge. If this is done, then it is recommended that the radius of curvature of the blade leading edge be increased so as to minimize fabric wear.

Figure 4:
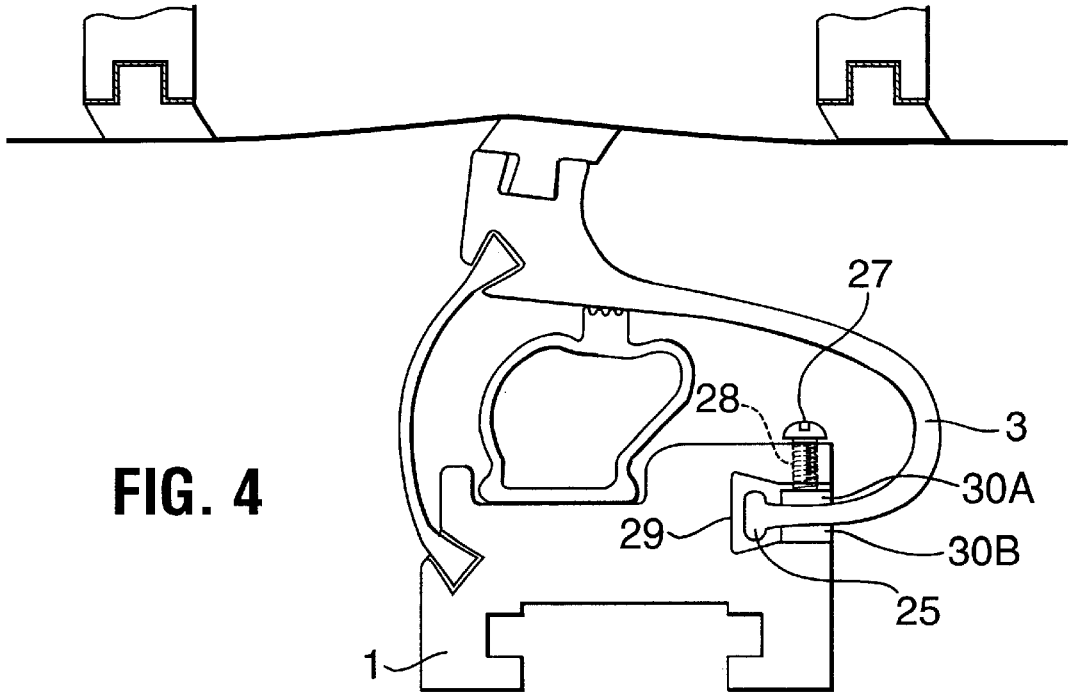
FIGS. 4, 5, 6, 7 and 8 show alternative constructions of the mounting.
Figure 5:
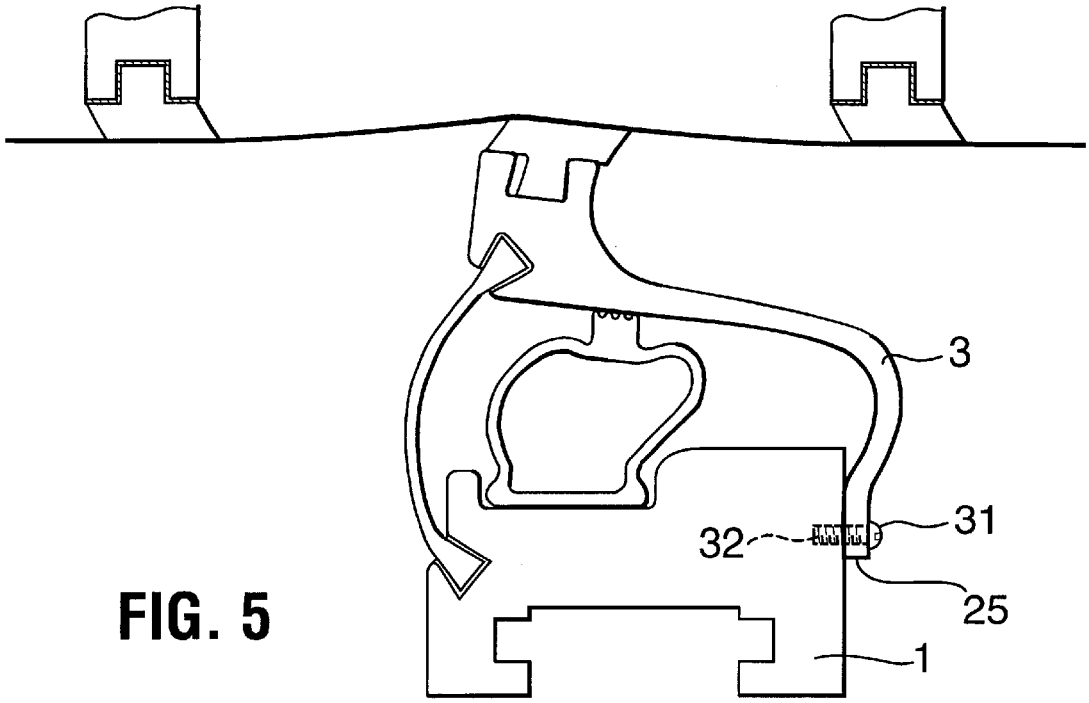
Figure 6:
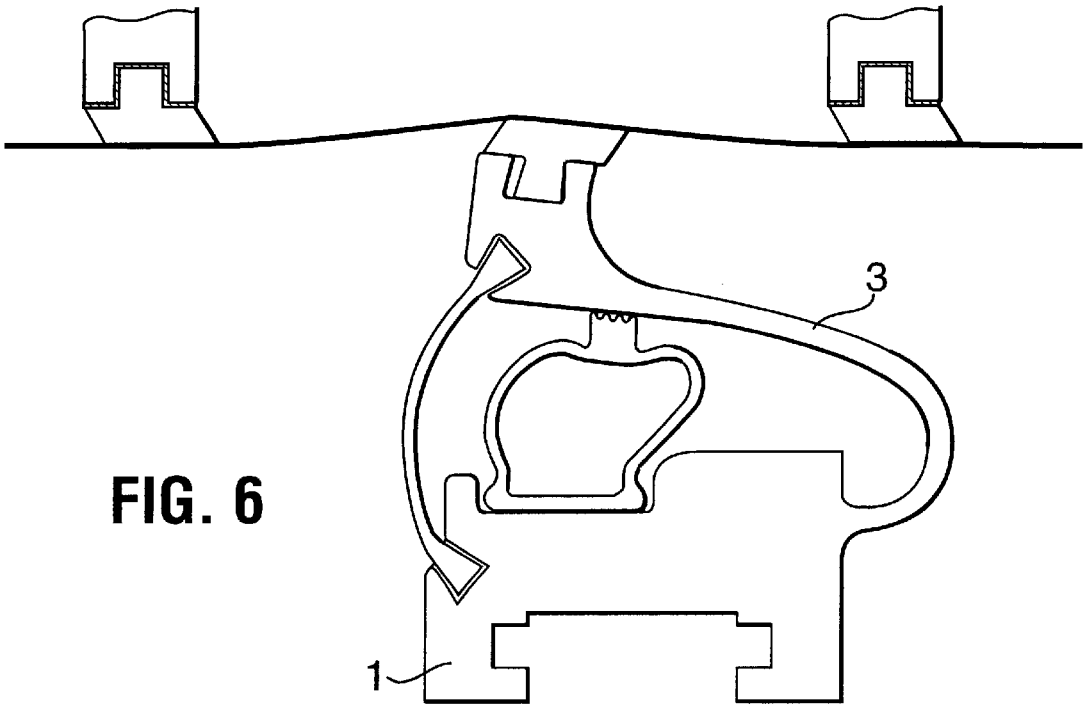

Alternative arrangements for attaching the C-shaped beam 3 to the base member 1 are shown in FIGS. 4, 5 and 6.

In the construction shown in FIG. 4, the ribbed first edge 25 of the C-shaped beam 3 is secured in place in the tapered slot 29. A locking bolt 27 seated in a threaded hole 28 serves to clamp the edge 25 between strips 30A and 30B. In this construction, the slot 29 can be made narrower, and either or both of the strips 30A and 30B can be omitted.

In the construction shown in FIG. 5, the ribbed first edge 25 of the C-shaped beam 3 is attached directly by bolts 31 in threaded holes 32 in the base member 1.

In the construction shown in FIG. 6, the C-shaped beam 3 and the base member 1 are fabricated as a single unitary construction.

Other forms of suitable mechanical engagement means are also well known and can be used.

The constructions shown in FIGS. 1–6 in practice have also been found in certain circumstances to have a disadvantage. If the quantity of liquid being doctored off by the blade 13 is relatively high, splash-back can occur. This has the effect of at least some of the doctored off liquid being projected laterally and upwardly toward the machine side of the adjacent forming fabric as it moves toward the blade 13. This can result in at least some of the splashed back liquid re-entering the adjacent oncoming forming fabric, with a deleterious effect on the formation process going on between the two opposed forming fabrics. The construction shown in FIGS. 7 and 8, together with the cross section shown in FIG. 9, overcomes this difficulty. As shown in both FIGS. 1, 2, 3, 4, 5 and 6, the forming fabrics 17 move in the direction of the arrow A. It is also contemplated that by reversing the positions of the trailing and leading edges 23, 24 of the blade 13, the mounting can be used with forming fabrics traveling in the direction of the arrow D in FIG. 3.

Figure 7:
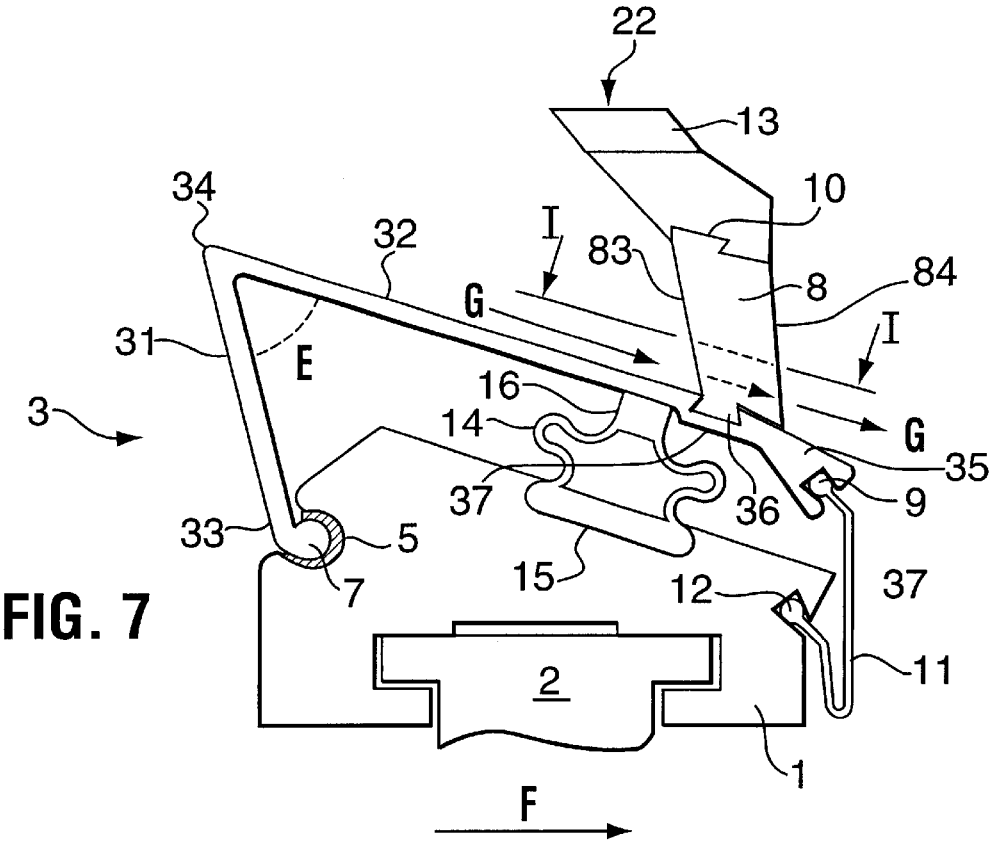
Figure 8:
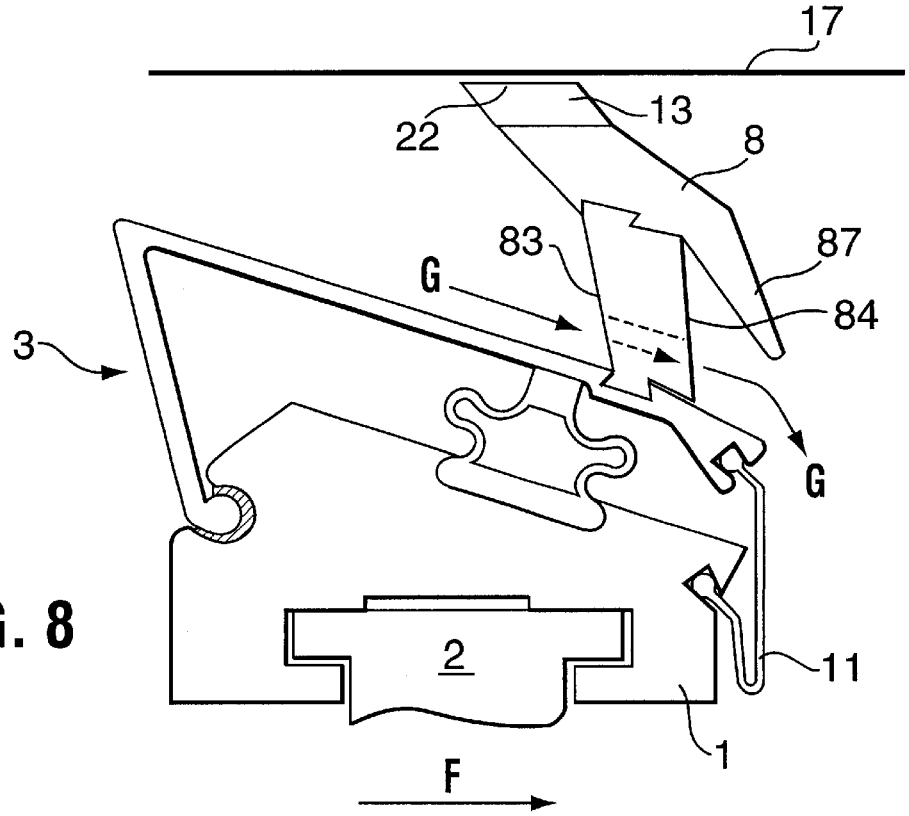

A further alternative structure for the C-shaped beam is shown in FIGS. 7 and 8. In this construction, the C-shaped beam 3 consists essentially of a first beam portion 31 and a second beam portion 32. These two portions are each essentially flat. The first edge 33 of the first portion 31 includes a rib 7 which is secured into the slot 5 in the base member 1. The second edge of the first beam portion 31 and the first edge of the second beam portion 32 are attached together along the line 34, at a suitable angle E. This angle is chosen to suit the desired overall height (in the Z-direction) of the mounting. In this construction it is preferred that the two beam portions 31 and 32 of the C-shaped beam are fabricated as a unitary structure. The fabric contacting blade attachment means 8 is attached to the second edge 35 of the second beam portion 32. As shown, a cooperating rib 36 and slot 37 is used to attach the attachment means 8 to the C-shaped beam 3. The remainder of the construction is essentially the same as that shown in FIGS. 1–5.

Figure 9:
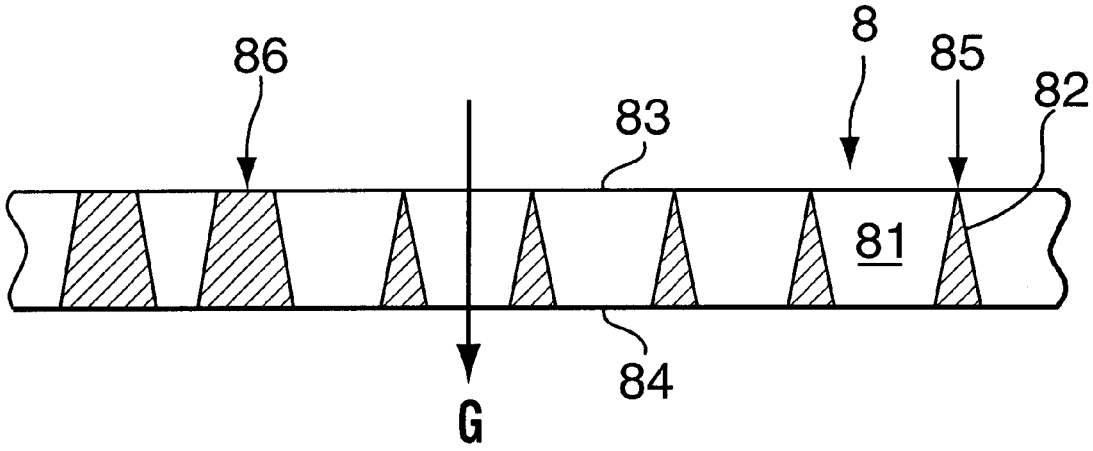
FIG. 9 shows a cross section on the line I—I of FIG. 7.

In this construction, the attachment means 8 is not solid as in the other Figures, but instead is provided with a venting means, through which at least a proportion of any liquid accumulating on the leading face 84 of the attachment means 8 can be vented at its trailing face 85. By this expedient, enough of the liquid doctored off by the blade 13 can be transferred to the trailing face of the attachment means 13 to eliminate substantially the risk of splash-back. FIG. 9 shows in cross section a part of the attachment means 8 including a suitable venting means. A series of slots 81 with tapered spacers 82 between them are provided in the attachment means 8, between the leading face 83 and the trailing face 84. The slots are spaced apart along the attachment means 8 in the cross machine direction. In order to avoid obstruction of the slots by solid from the stock, it is preferred that the spacers 82 should have an angled leading edge as shown at 85; a flat space as at 86 between the slots 81 is not desirable. At least a portion of the doctored off liquid then follows the path indicated schematically by the arrows G, and is drained away from the space downstream of the blade mounting. A further variation on this construction is also shown in FIG. 8. On the trailing face 83 of the attachment means 8 a deflector rib 87 is provided, which serves to deflect the liquid vented through the slots 81 away from the machine side of the adjacent forming fabrics 17. The arrangement shown in FIG. 3, with the forming fabric moving in the direction of the arrow D, may also serve to alleviate splash-back problems.

It should be noted that in fabricating an attachment means 8 including slots 81 and spacers 82 care should be taken to ensure that the resulting structure is sufficiently strong to support the element 13 properly. It should also be noted that, unlike the construction shown in FIGS. 1–5, it is recommended that the form of construction shown in FIGS. 7 and 8 should not be reversed, and should only be used with the forming fabrics moving in the direction shown at F.

The mounting including the arcuate or angled flexible C-shaped beam structure 3 also provides a yielding, somewhat pliant support for the blade 13 in the Z-direction across the width of the forming section, which allows the mounting to flex in response to localized variations in the path of the forming fabrics. Variations in the location of the fabric surface across the width of the machine, essentially in the Z-direction relative to the blade surface, may be caused by various factors, such as uneven stock flows, temperature variations, localized variations in the wear surfaces of the blades themselves, or misalignment of the mounting structures supporting blades. This level of flexibility in the mounting also allows the blade 13 to conform to such localized variations, while applying a constant and even pressure to maintain thus retaining the face 22 of the blade in intimate contact with the machine side of one of the moving forming fabrics.

The loading of the tube 14 may be accomplished either pneumatically or hydraulically. Hydraulic pressure is preferred, since it provides a higher degree of control than gasses and provides viscous dampening of any blade vibration.

In this mounting, there are no moving components which are susceptible to sliding friction to move the blade, and the presence of the elastomer sealing strip 11 eliminates areas where fibers and solids can accumulate. It is therefore not recommended that the sealing strip be omitted, although the mounting will function without it.

By means of this invention, it is now possible if desired to employ blades whose leading edges have a much smaller radius of curvature than those utilized in "conventional" mounting assembly designs so as to reduce the occurrence of re-entrant water. Water re-entry is the result of the water layer that clings to the machine side surface of the fabric that is not doctored off by the leading edge of the blade 13. This water becomes driven back into the sheet disrupting sheet formation. In the mounting assembly of the present invention, the entire fabric contacting surface of the blade can be maintained in contact with the fabric so that it is in intimate contact with the machine side of the fabric. Consequently, the leading edge can be as sharp as is practical so as to skim off any fluid clinging to the machine side of the fabric. As the blade 13 is pressed in the Z-direction further into the fabrics 17, the mounting allows the blade 13 to move so that the wrap angle of the fabrics at the leading edge 24 of the blade 13 is minimized, and the wrap angle at the trailing edge 23 of the blade 13 is maximized.

The C-shaped beam 3 can be fabricated from a variety of materials, including both metals, such as spring steels, stainless steels, and fibre reinforced plastics such as so-called "fiberglass", which is the presently preferred material. Similar materials can also be used when the C-shaped beam and the base member 1 are fabricated as a single unit. Since the conditions of use vary significantly between paper making machines, some experimentation is required to obtain the desired level of flexibility in the C-shaped beam 3. If an adhesive is used to retain the C-shaped beam in the base member 1, such as an elastomer based adhesive, a casting compound, or a potting compound, after curing it should be relatively stiff, thus providing a mounting somewhat similar in properties to the well known rubber-in-shear bushes. Under certain circumstances, it may be required to use a more rigid means of engaging the C-shaped beam, such as the mechanical engagement arrangements discussed above or a unitary construction of the C-shaped beam and the base member combined. Alternatively, when an adhesive is used the engagement can be stiffened by choosing the fit between the edge 4 of the C-shaped beam 3 and the slot 5 so that the amount of adhesive can be minimized. Additionally, when a C-shaped beam with two substantially flat beam portions is used, the construction can be arranged so that the first beam portion is essentially rigid, and serves primarily to support a flexible second beam portion. It is thus clear that for any specific set of operating conditions some experimentation will likely be required to obtain the desired degree of flexibility.

Similarly, the base member 1 and the attachment means 8 can each be fabricated from a variety of materials, including both metals, reinforced plastics, and engineering plastics. The preferred material is fiber reinforced plastic, such as so-called "fibreglass". Although the base member 1 is shown as having a substantially rectangular cross-section, other cross-sectional shapes, both tubular and solid, can be used.

What is claimed is:

1. A flexible mounting in the forming section of a twin forming fabric paper making machine for a blade consisting essentially of:

a base member constructed and arranged to be supported by a paper making machine structure, a flexible C-shaped beam, having a first beam portion having a first edge and having a second beam portion having a second edge, the first edge of the first beam portion being attached to the base member;

a fabric contacting blade attachment means, having a leading and trailing face, attached to the second edge of the C-shaped beam; and a pressurised loading tube located within the c-shaped beam between the base member and the second edge of the C-shaped beam; wherein:

(i) the flexible mounting involves no parts moving in sliding contact, and (ii) the flexible C-shaped beam is constructed and arranged to allow the blade to rotate over an arc as it is displaced towards the twin forming fabrics by the pressurised tube.

2. A mounting according to claim 1 including a two part construction comprising the C-shaped beam and the base member.

3. A mounting according to claim 1 including a unitary construction comprising the C-shaped beam and the base member.

4. A mounting according to claim 1 wherein the first and second beam portions are both arcuate to provide the C-shaped beam.

5. A mounting according to claim 1 wherein the first beam portion has a second edge, the second beam portion has a first edge, the first and second beam portions are both substantially flat, and the second edge of the first beam portion is attached at an angle at its second edge to the first edge of the second beam portion to provide the C-shaped beam.

6. A mounting according to claim 1 wherein the first beam portion has a second edge, the second beam portion has a first edge, the first and second beam portions are both substantially flat, the second edge of the first beam portion is attached at an angle at its second edge to the first edge of the second beam portion to provide the C-shaped beam, and the first and second beam portions are a unitary structure.

7. A mounting according to claim 1 further including a flexible sealing means located between the second edge of the C-shaped member and the base member.

8. A mounting according to claim 2 wherein the C-shaped beam is rigidly attached to the base member.

9. A mounting according to claim 2 wherein the C-shaped beam is flexibly attached to the base member.

10. A mounting according to claim 9 wherein the first edge of the C-shaped beam is attached to the base member by being lodged into a slot in the base member constructed and arranged to receive the first edge, and the first edge is retained therein by a flexible adhesive compound.

11. A mounting according to claim 8 wherein the first edge of the C-shaped beam is attached to the base member by a mechanical attachment means.

12. A mounting according to claim 11 wherein the mechanical attachment means is chosen from at least one member of the group consisting of a slot and lockbolt means, or a bolt means.

13. A mounting according to claim 7 wherein the flexible sealing means comprises a strip, the edges of which are engaged in cooperating slots in the second edge of the second portion of the C-shaped beam and in the base member.

14. A mounting according to claim 1 wherein the pressurized loading tube is located in a slot in the base member.

15. A mounting according to claim 1 wherein the pressure tube further includes a pressure rib adapted to engage the second edge of the second portion of the C-shaped beam.

16. A mounting according to claim 1 wherein the C-shaped beam is fabricated from a material chosen from the group consisting of a fiber reinforced plastic material, a spring steel, and a stainless steel.

17. A mounting according to claim 2 wherein the C-shaped beam is fabricated from a fiber reinforced plastic material.

18. A mounting according to claim 1 wherein the base member is fabricated from a material chosen from the group consisting of a fiber reinforced plastic material, a spring steel, and a stainless steel.

19. A mounting according to claim 2 wherein the base member is fabricated from a fiber reinforced plastic material.

20. A mounting according to claim 3 wherein the unitary C-shaped beam and base member is fabricated from material chosen from the group consisting of a fiber reinforced plastic material, a spring steel, and a stainless steel.

21. A mounting according to claim 3 wherein the unitary C-shaped beam and base member is fabricated from a fiber reinforced plastic material.

22. A mounting according to claim 1 wherein the fabric contacting blade attachment means attached to the second edge of the C-shaped beam further includes a leading face and a trailing face, and liquid venting means connecting the leading face to the trailing face;

23. A mounting according to claim 1 wherein the liquid venting means is chosen from the group consisting of a series of holes or slots from the leading face to the trailing face through the fabric contacting blade attachment means, the holes or slots being spaced apart in the cross-machine direction.

* * * * *